US006672693B2

(12) United States Patent
Kawakami

(10) Patent No.: US 6,672,693 B2
(45) Date of Patent: Jan. 6, 2004

(54) COOLING RECEPTACLE

(75) Inventor: Takeshi Kawakami, Gunma (JP)

(73) Assignee: Sanyo Electric Co., Ltd., Osaka-fu (JP)

( * ) Notice: Subject to any disclaimer, the term of this patent is extended or adjusted under 35 U.S.C. 154(b) by 0 days.

(21) Appl. No.: 10/043,152

(22) Filed: Jan. 14, 2002

(65) Prior Publication Data

US 2002/0093276 A1 Jul. 18, 2002

(30) Foreign Application Priority Data

Jan. 15, 2001 (JP) ..... 2001-006588

(51) Int. Cl.[7] ..... A47B 96/04; A45C 13/22
(52) U.S. Cl. ..... 312/405; 16/436
(58) Field of Search ..... 312/405, 326, 312/329, 324; 16/415, 412, 436, 111.1, 419; 220/318, 741, 752, 846

(56) References Cited

U.S. PATENT DOCUMENTS 2,329,298 A * 9/1943 Ring et al. ..... 16/436
3,766,598 A * 10/1973 Roberts ..... 16/444
3,846,902 A * 11/1974 Sebring ..... 29/458
3,850,464 A * 11/1974 Bisbing et al. ..... 292/175
4,038,718 A * 8/1977 Reilhac et al. ..... 292/336.3
5,476,318 A * 12/1995 Yingst et al. ..... 312/405
5,553,354 A * 9/1996 Trulaske, Sr. ..... 16/412
5,706,554 A * 1/1998 Ruckert et al. ..... 292/336.3
5,740,587 A 4/1998 Onai et al.
6,039,366 A * 3/2000 Lewis ..... 292/352
6,295,787 B1 * 10/2001 Lee ..... 52/784.15

FOREIGN PATENT DOCUMENTS

DE 1751718 * 10/1971 ..... F25D/23/02
JP 10304999 A * 11/1998 ..... A47L/15/42

* cited by examiner

*Primary Examiner*—Lanna Mai
*Assistant Examiner*—John Fitzgerald
(74) *Attorney, Agent, or Firm*—Sughrue Mion, PLLC

(57) ABSTRACT

A cooling receptacle capable of making an installing operation of a handle simpler and fixing the handle on an exterior member or material strongly is provided. The cooling receptacle having a storage room in a heat-insulated housing which has an opening in a front side, said opening being adjustable to open or close by a door, comprising a cut formed in an exterior member of the door a screw hole formed in the exterior surface near the cut, a handle base connected to the cut so as to cover the cut, and a main body of the handle provided in the handle base and fixed in the exterior member by a screw which is screwed to the screw hole, said handle base being provided with a flange extending to a back surface of the exterior member in which the screw hole is placed, and said flange having an installing section for a nut member or material which is held between a holding section and the exterior member by screw.

2 Claims, 7 Drawing Sheets

COOLING RECEPTACLE

FIELD OF THE INVENTION

The present invention relates to a cooling receptacle having a storage chamber or room in a heat-insulated housing, and an opening in its front side which is adjustable to open/close by a door filled with an insulating material therein.

BACKGROUND OF THE INVENTION

In such cooling receptacle, an opening which is provided in the front side of a heat-insulated housing is conventionally closed by an open/close adjustable door which is supported for rotation by a pivot. The door is composed of an exterior member or material, an interior member or material and a foam heat-insulating material for filling a space or gap between the exterior member and the interior member. Further, a handle for opening/closing the door is installed in the front surface of the door. The handle is composed of a handle base to be directly fixed in the exterior member, a main body thereof, and a handle cover. After the handle base is fixed on the exterior member, the main body of the handle is installed in the handle base and then the handle cover is installed in the front surface of the main body.

In case where the handle base is installed in the exterior member, a nut member or material is held in the back side of the exterior member, and an installing section of the handle base is held on the front surface of the exterior member and is fixed by a screw. Then, the main body of the handle is fixed in the handle base and the handle cover is installed in the front surface of the main body of the handle.

However, in case of fixing the handle base, the nut member has to be held from the back side of the exterior member, for example, by fingers and the handle base is screwed while it is held in the front side of the exterior member. There is a problem that an installing operation of the handle is complicated because it is difficult to fix the handle base while comparatively small nut member is held.

An object of the invention is to solve the conventional technical problem, to make the installing operation of the handle simpler, and to provide a cooling receptacle in which the handle can be strongly fixed in the exterior member.

SUMMARY OF THE INVENTION

The object of the invention can be achieved by cooling receptacle comprising a storage room installed in a heat-insulated housing which has an opening in its front side, an open/close adjustable door in which an insulating material is filled and which stops up the opening, a cut formed in an exterior member of the door, a screw hole formed in the exterior member near the cut, a handle base connected to the cut so as to cover it, a handle provided in the handle base and fixed in the exterior member by the screw which is screwed to the screw hole, a flange extending to a back side of the exterior member in which the screw hole is placed, and a holding section for a nut member which is held between the holding section and the exterior member by screw.

According to the invention, the cooling receptacle having the storage room in the heat-insulated housing which has the opening in its front side, said opening adjustable to open or close by the door in which the insulating material is filled, is composed of the cut formed in the exterior member of the door, the screw hole formed in the exterior surface near the cut, the handle base connected to the cut so as to cover the cut, the handle provided in the handle base and fixed in the exterior member with the screw which is screwed to the screw hole, the flange provided in the back surface of the exterior member in which the screw hole is placed, and the holding section for the nut member which is held between the holding section and the exterior member by screw. According to the configuration, since the flange of handle base is held in the back side of the exterior member and the handle is placed in the handle base, all of the handle, the exterior member and the handle base are fixed by screw together.

The holding section is formed in the flange of the handle base, and the nut member which is connected to the holding section by a screw can be held in the holding section. As a result, the screw can be easily in line with the nut member and the handle can be strongly fixed in the exterior member.

In case where the handle is installed, the nut member is placed in the holding section of the handle base and the flange of the handle base is slid along the back side of the exterior member to hold the handle base in the cut of the exterior member. As a result, the installing operation of the handle can be simplified.

In the cooling receptacle of the second invention, the holding section of the flange has a path in which the insulating material is incorporated.

According to the second invention, the insulating material is incorporated through the path and is filled between the holding section of the flange and the exterior member, whereby the nut member existing in the holding section of the flange is pressed to the back side of the exterior member to strongly fix the handle base in the exterior member.

DESCRIPTION OF THE PREFERRED EMBODIMENTS

Figure 1:
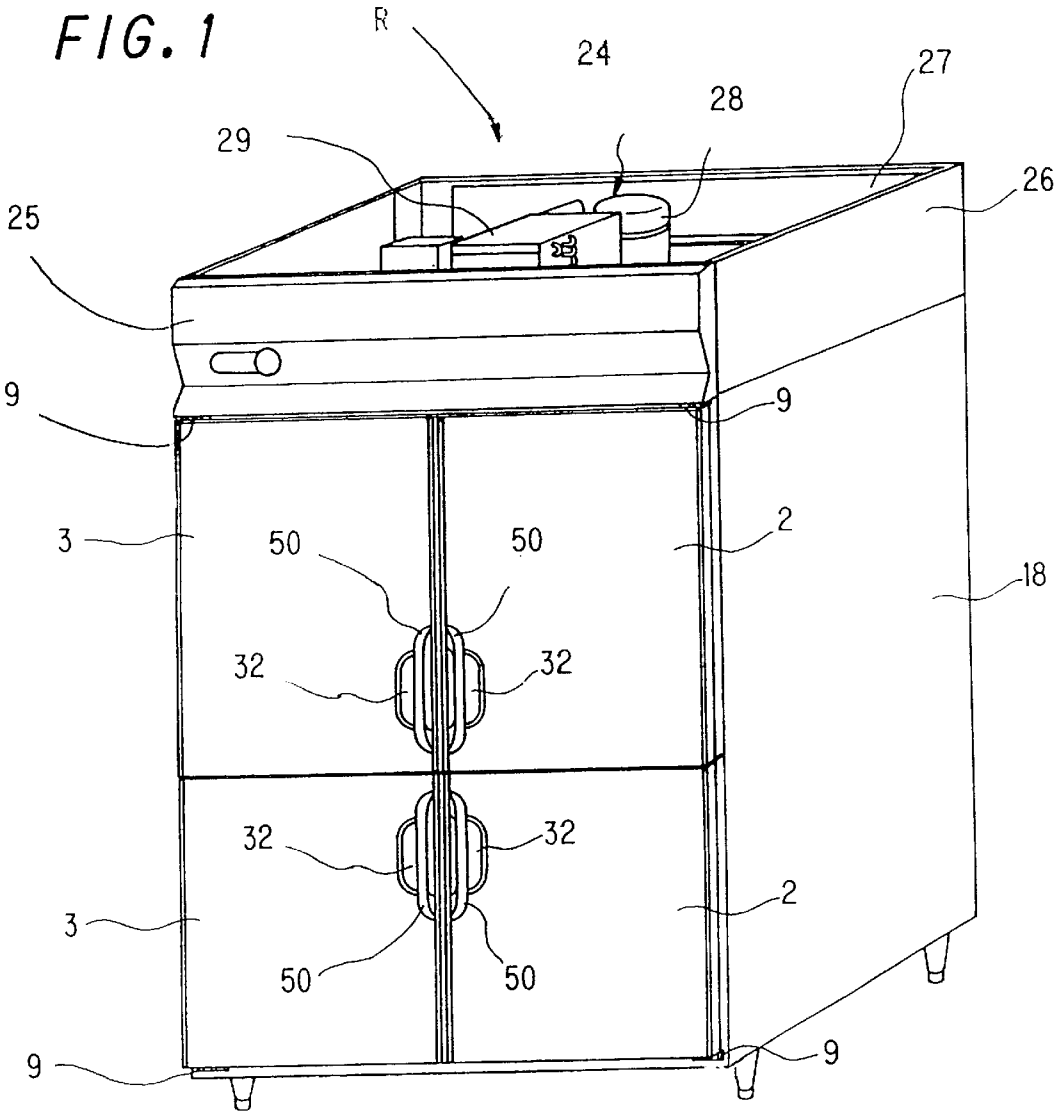
FIG. 1 is a perspective view showing a cooling receptacle of the invention.
Figure 2:
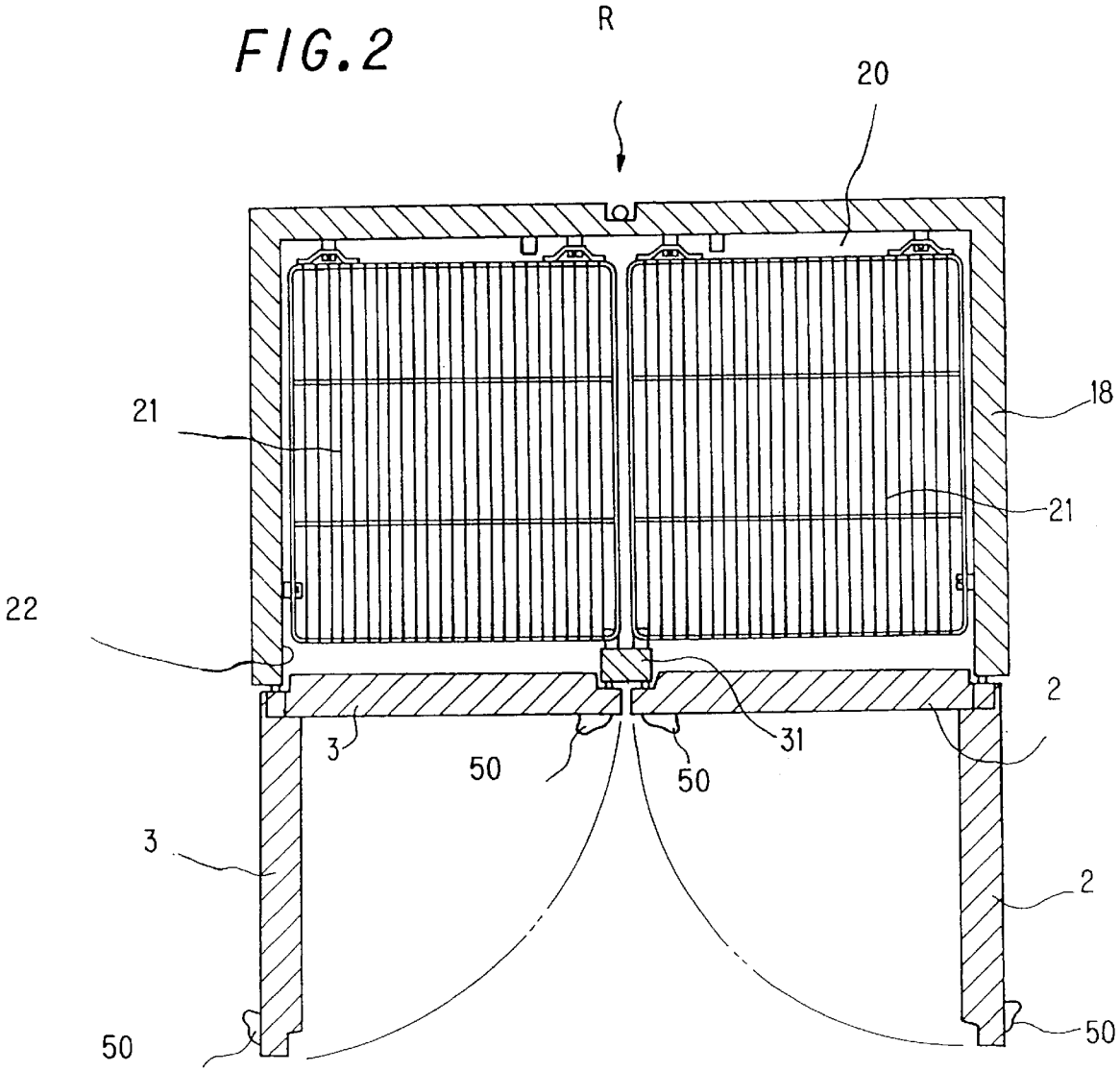
FIG. 2 is a horizontal cross-sectional view showing a cooling receptacle of the invention.
Figure 5:
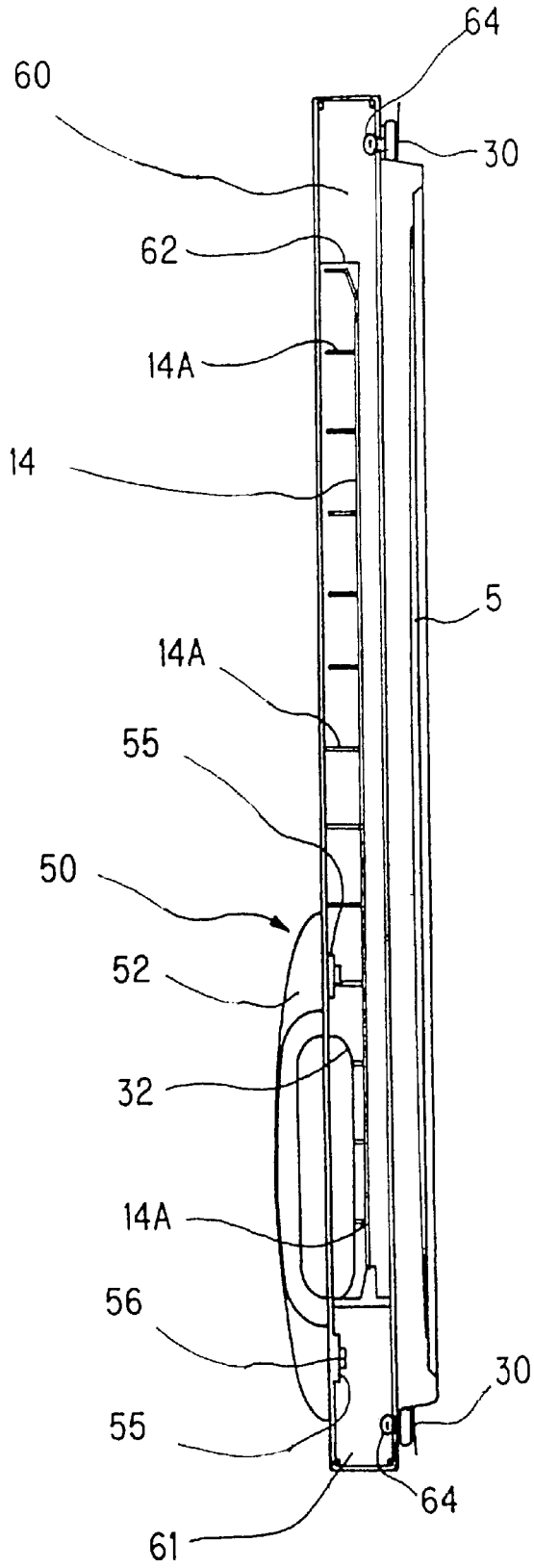
FIG. 5 is a vertical cross-sectional side view showing a door in the side that is not supported by a pivot.

Referring to the drawings, the examples of the invention will be explained in more detail. FIG. 1 is a perspective view of the cooling receptacle R in the invention, and FIG. 2 is a horizontal cross-sectional view of the cooling receptacle R in the invention. The cooling receptacle R in the example is a vertical refrigerator for commercial use which is installed in a kitchen of hotels and restaurants and which is composed of a heat-insulated housing 18 having an opening in its front side. Shelves 21—for placing cooked foods (dishes) and cooking materials thereon are installed in a storage room 20 provided in the heat-insulated housing 18. An opening 22 provided in the front side of the storage room 20 is horizontally divided in its center portion into upper and lower parts by a separator (not shown). A column 31 for receiving a gasket 30 (as shown in FIG. 5) of a door 2, 3 which will be illustrated hereinafter in detail is installed in vertical center portion of the opening 22.

A cooler (not shown) of a cooling device 24 is installed in upper portion of the storage room 20 which is cooled to a predetermined temperature. A machine room 27 having a front panel 25 and a panel 26 forming side walls and rear wall exists on the top wall of the heat-insulated housing 18. A compressor 28 and a condenser 29, which are members of the cooling device 24, are installed in the machine room 27 and form a well-known cooling circuit for the cooling device 24 with the above cooler.

Figure 3:
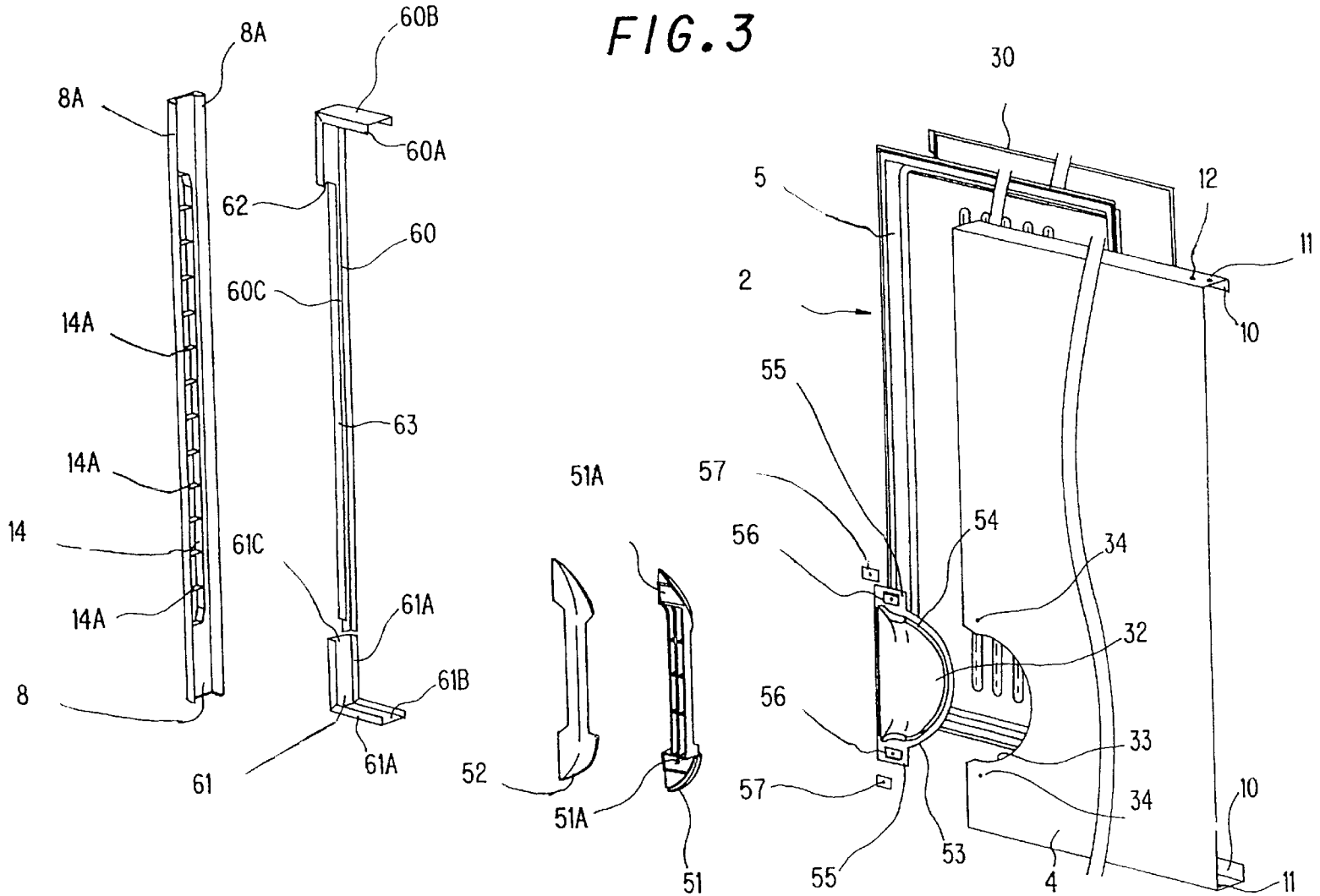
FIG. 3 is an exploded top view showing a door in the side that is not supported by a pivot.
Figure 4:
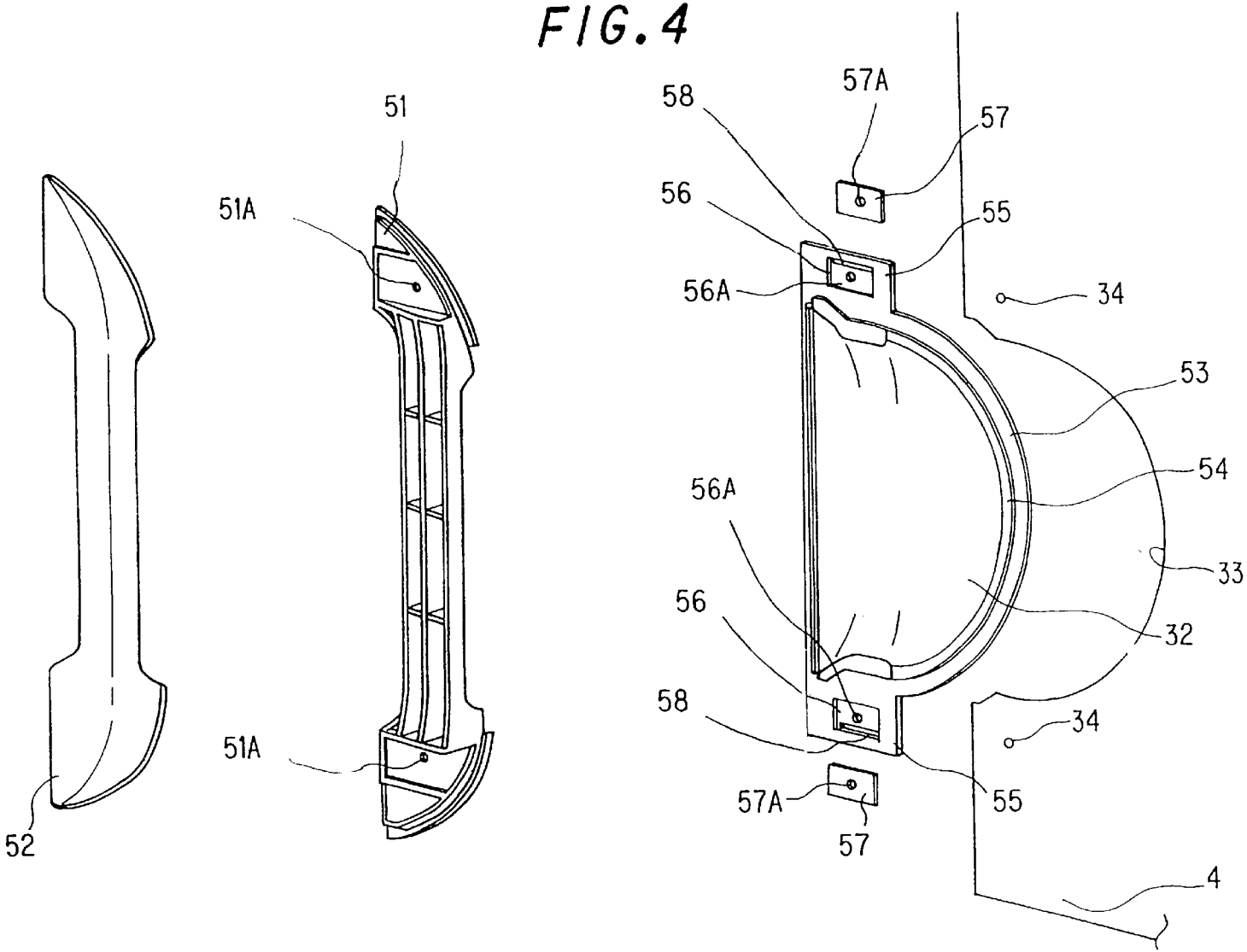
FIG. 4 is an enlarged and exploded top view showing a handle section.
Figure 6:
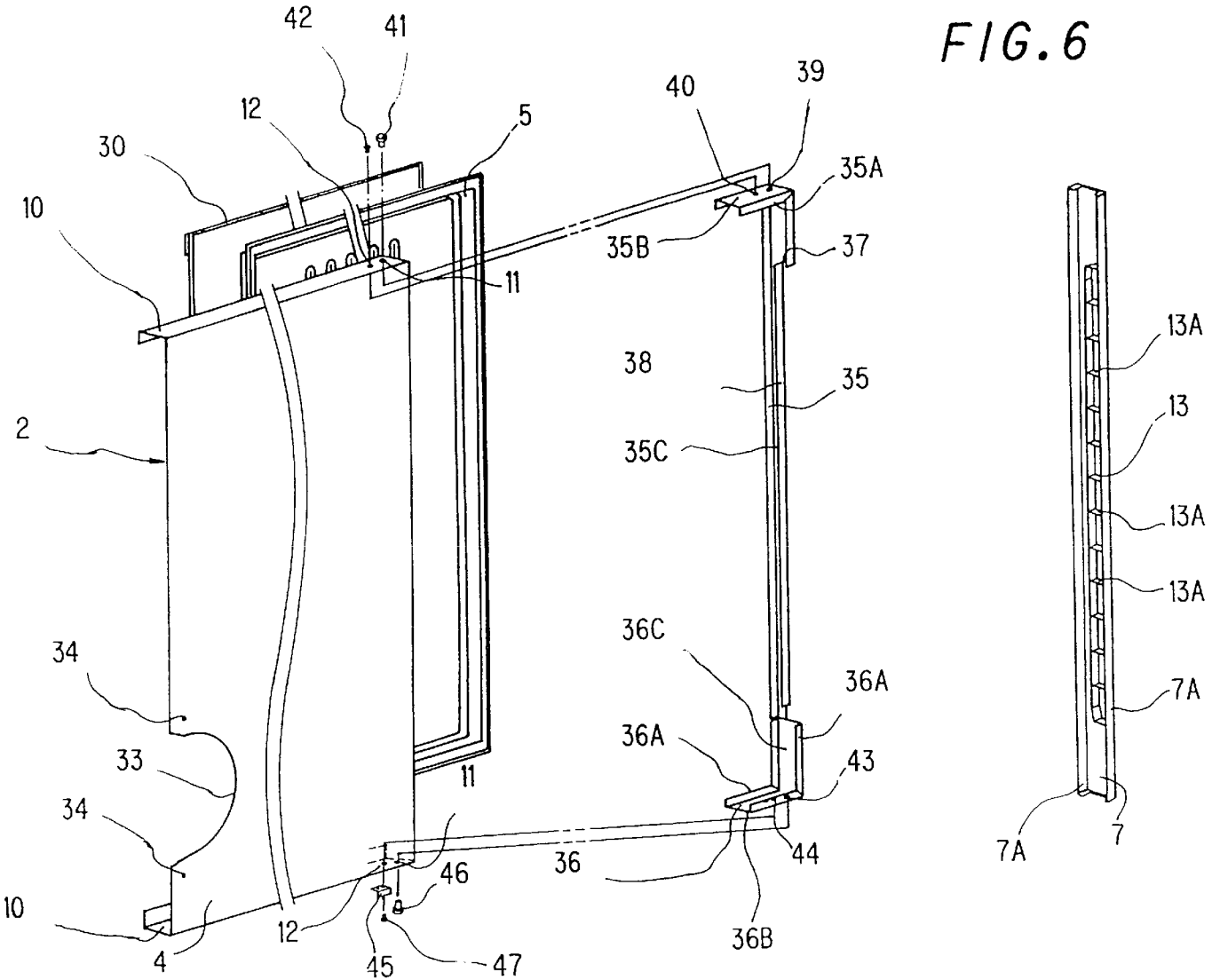
FIG. 6 is an exploded top view showing a door in the side that is supported by a pivot.
Figure 7:
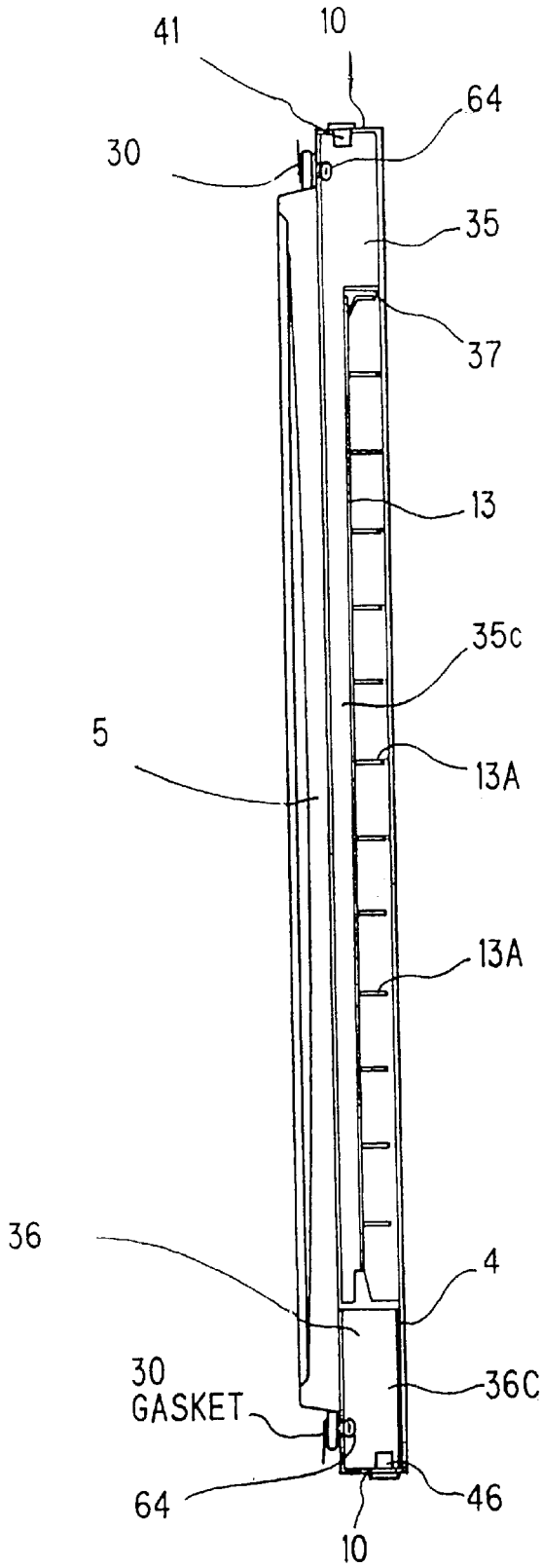
FIG. 7 is a vertical cross-sectional side view showing a door in the side that is supported by a pivot.

The upper and lower portions of the opening 22 in the storage room 20 which are made by dividing the opening 22 by the separator can be closed by two pairs of retractable double doors 2, 3. Referring to FIGS. 3 to 7, the door 2, 3 will be explained. FIG. 3 is an exploded top view of the door 2 in the side that is not supported by a pivot. FIG. 4 is an enlarged and exploded top view of a handle section. FIG. 5 shows a vertical cross-sectional side view of the door 2 in the side that is not supported by the pivot. FIG. 6 is an exploded top view of the door 2 in the side that is supported by a pivot. FIG. 7 is a vertical cross-sectional side view of the door 2 in the side that is supported by the pivot. The door 2, 3 each is composed of an exterior member 4, an interior member (material) 5, a cap 7 in the side that is supported by the pivot, a cap 8 in the side that is not supported by the pivot, and a foam heat-insulated material (not shown).

The exterior member 4 is formed by a plate-like member such as a steel plate. When the exterior member 4 is installed on the interior member 5, top and bottom ends of the exterior member 4 are bent to the side of the interior member 5 so as to making them to face in and to provide a flange 10. In the flange 10 formed in the top and bottom ends of the exterior member 4 which are located in the sides that are supported by pivots, a hinge hole 11 and a screw hole 12 are provided as a hinge engagement section for installing a hinge member or material 9 by which the door 2 is supported for rotation in the opening 22 of the heat-insulated housing 18.

The side ends of the exterior member 4 are cut according to a width of the cooling receptacle R and a handle 50 is installed in the side of the exterior member that is not supported by pivot. The handle 50 is composed of a main body 51 of the handle and a handle cover 52, and is fixed through a handle base 32 in the exterior member 4.

A cut 33 for installing the handle base 32 is formed in the side of the exterior member 4 that is not supported by pivot. A screw hole 34 for fixing the handle base 32 is formed near the cut 33 (over and beneath the cut in the example).

As is shown in FIGS. 3 and 4, the handle base 32 is sunk backwards or recess, and a lower flange 53 is provided along the handle base 32 which is engaged with the cut 33. In the front surface of the lower flange 53 which is recess to the back side of the handle base 32, an upper flange 54 is provided so that a groove is formed between the upper flange 54 and the lower flange 53. An installing section 55 extending upward and downward is provided in upper and lower portions of the lower flange 53. A holding section (or recess) 56 sinking backward is provided in the installing section 55. The holding section 56 can accommodate a nut member 57 which is substantially same size as inner size of the holding section 56 for installing the main body of the handle in the exterior member 4.

The holding section 56 has a screw hole 56A matching with a screw hole 57A to the nut member 57. A path 58 is formed in an upper portion of the upper holding section 56 and in a lower portion of the lower holding section 56.

The main body 51 of the handle has an installing hole 51A, in upper and lower portions, matching with the screw hole 56A which is provided in the holding section 56 of the handle base 32. The handle cover 52 is detachable and attachable to the main body 51 of the handle by engagement section formed in outer peripheral portion.

In case where the handle 50 is installed in the exterior member 4, the lower flange 53 of the handle base 32 is engaged with the inner surface of the exterior member 4 so as to cover the cut 33. In the case, a peripheral end portion of the cut 33 of the exterior member is inserted in the groove which is formed by the lower flange 53 and the upper flange 54 of the handle base. Thus, the peripheral end portion of the cut 33 in the exterior member 4 is held by the lower flange 53 and the upper flange 54. The screw hole 34 of the exterior member 4 matches with the screw hole 56A formed in the holding section 56 of the handle base 32.

After the nut member 57 is placed in the holding section 56 of the handle base 32, the installing section 55 of the handle base 32 is put on the back side of the exterior member and the main body 51 of the handle is placed. In the case, the installing hole 51A of the main body 51 of the handle matches with the screw hole 34 of the exterior member 4, and the main body 51 of the handle, the exterior member 4 and the handle base 32 are fixed together by a screw (not shown).

In the case, the holding section 56 on the handle base 32 can hold the nut member 57 screwed together with the holding section 56. Accordingly, a screw is easily fastened on the nut member 57 and the handle is strongly fixed in the exterior member.

In case where the main body 51 of the handle is installed, the nut member 57 is placed in the holding section 56 of the handle base 32, and the lower flange 53 of the handle base 32 is slid along the back side of the exterior member 4 to install the handle base 32 in the cut 33 of the exterior member 4. As a result, the installing operation of the main body 51 is simplified.

Further, as described below, by filling a foam heat-insulating material in a space between the exterior member 4 and the interior member 5, the foam heat-insulating material enters from a path 58 formed in the holding section 56 of the handle base 32 and is filled in the space between the exterior member 4 and the interior member 5, whereby the nut member 57 in the holding section 56 is pushed to the back side of the exterior member 4 and the handle base 32 is strongly fixed to the exterior member 4. The handle cover 52 is installed in the front surface of the main body 51.

A cap 8 is installed in the side of the exterior member 4 that is not supported by pivot. The cap 8 is a plate-like member made by a resin and is formed as a cover member from the upper end to the lower end in the side edge of the exterior member 4 that is not supported by pivot. The cap 8 has a flange 8A in the front and back ends thereof, which covers the flange 10 of the exterior member 4 from the side thereof.

A reinforcement frame 14 is provided in an inner side of the cap 8 that is not supported by pivot from upper portion to lower portion thereof. The frame 14 and the cap 8 are single-piece construction so that a plurality of frames 14A jut from the front portion to the middle portion of the cap 8, whereby the cap 8 is reinforced and is strongly formed.

A frame 14A located in a position contacted with the handle base 32 is formed so that it sinks backward and in the side direction along the shape of the handle base 32. The frame 14 has the shape to avoid the handle base 32. Thus, the installing operation of the handle base can be carried out without troublesome.

A reinforcement plate 60 for upper cap and a reinforcement plate 61 for lower cap, which are made by a steel plate, are installed in the inner side of the cap 8 in the side that is not supported by pivot. The reinforcement plate 60 for the upper cap is a plate-like member of which cross-section is in the form of L-letter, and has a flange 60A in the front and rear surfaces. The reinforcement plate 60 for the upper cap is smaller in width than a flange 10 provided on the upper end of the exterior member 4. A lower surface 60B constituting a surface of the L-letter form is contacted with the inner side of the upper end in the exterior member 4. A side surface 60C constituting the other side of the L-letter form extends downward. In the side surface 60C, a notch 62 is provided which is connected to the reinforcement frame 14 formed in the inner side of the cap in the side that is not supported by pivot. A flange 63 to be connected to the reinforcement frame 14 is formed in the front end of the notch 62.

The resin-made cap in the side that is not supported by pivot can be reinforced to increase strength of the door 2, 3, because the reinforcement plate 60 is installed in the inner side of the cap 8 in the side that is not supported by pivot.

The reinforcement plate 61 for the lower cap is a plate-like member in the form of L-letter made by a steel thicker than the reinforcement plate 60 for the upper cap, and has a flange 61A in the front and rear surfaces. The reinforcement plate 61 for the lower cap is smaller in width than a flange 10 provided in the lower end of the exterior member 4. A lower surface 61B constituting a surface of the L-letter form is contacted with the inner side of the lower end in the exterior member 4. A side surface 61C constituting the other side of the L-letter form extends downward to the reinforcement frame 14 of the cap in the side that is not supported by pivot.

The reinforcement plate 61 for the lower cap to which a load of the door 2, 3 is added can strongly hold the doors 2, 3 because it is made by a steel plate thicker than that of the reinforcement plate 60 for the upper cap.

The cap 7 in the side that is supported by pivot is a cover member which is installed at the side end in the side of the exterior member 4 that is supported by pivot, as well as the cap 8 in the side that is not supported by pivot, and is a resin-made plate-like member which is formed from the upper end to the lower end of the exterior member 4. The cap 7 in the side that is supported by pivot is a cover member has a flange 7A in the front and rear ends, and is formed so as to cover the flange 10 of the exterior member 4 from side direction thereof.

A reinforcement frame 13 is formed from the upper front portion to the lower front portion in the cap 7 in the side that is supported by pivot. The reinforcement frame 13 and the cap 7 are single-piece construction so that a plurality of frames 13A jut from the front portion to the middle portion of the cap 7, whereby the cap 7 is reinforced and is strongly formed. In the case, the frame 13 formed in the cap 8 has the shape to avoid the handle base 32 as well as the cap 8 in the side that is not supported by pivot. Thus, similar member can be used for the cap 8 and the cap 7, and the number of parts can be reduced.

On the other hand, a reinforcement plate 35 for the cap and a reinforcement plate 36 for the hinge, which are made by a steel plate, are installed in the inner side of the cap in the side that is supported by pivot. The reinforcement plate 35 for the cap is a plate-like member of which cross-section is in the form of L-letter, and has a flange 35A in the front and rear surfaces. The reinforcement plate 35 for the cap is smaller in width than a flange 10 provided on the upper end of the exterior member 4. An upper surface 35B constituting a surface of the L-letter form is contacted with the inner side of the upper end in the exterior member 4. A side surface 35C constituting the other side of the L-letter form extends downward. A notch 37 is provided which is connected to the reinforcement frame 13 formed in the inner side of the cap 7 in the side that is supported by pivot. A flange 38 to be connected to the reinforcement frame 13 is formed in the front end of the notch 37.

In the upper surface 35B of the reinforcement plate 35, a hinge hole 39 and a screw hole 40 are provided as a hinge engagement section which are in line with a hinge hole 11 and a screw hole 12 of the flange 10 formed in the upper end of the exterior member 4. In the condition that the reinforcement plate 35 is in line with the flange 10 formed in the upper end of the exterior member 4, a hinge collar 41 engaged with the hinge member 9 is installed from upper direction of the hinge holes 11 and 39, and a fixing screw 42 is installed from the upper direction of the screw holes 12 and 40.

Since the reinforcement plate 35 is installed in the inner side of the cap 7, the cap 7 made by a resin can be reinforced and the strength of the door 2, 3 can be increased.

A hinge reinforcement plate 36 for engagement of the hinge member 9 is not necessary because the hinge hole 39 for engagement of the hinge member 9 is formed by a single-action mold with the reinforcement plate 35 for the cap, whereby the number of the parts can be reduced.

The reinforcement plate 36 of the hinge is a plate-like member in the form of L-letter made by a steel and has a flange 36 in the front and rear surfaces. The reinforcement plate 36 is smaller in width than a flange 10 provided in the lower end of the exterior member 4. A lower surface 36B constituting a surface of the L-letter form is contacted with the inner side of the lower end in the exterior member 4. A side surface 36C constituting the other side of the L-letter form extends downward to the reinforcement frame 13 of the cap.

In the lower surface 36B of the reinforcement plate 36 of the hinge, a hinge hole 43 and a screw hole 44 are provided as a hinge engagement section which are in line with a hinge hole 11 and a screw hole 12 of the flange 10 formed in the lower end of the exterior member 4. In the condition that the reinforcement plate 36 is in line with the flange 10 formed in the lower end of the exterior member 4, a hinge collar 46 engaged with the hinge member 9 is installed from lower direction of the hinge holes 12 and 43, and a fixing screw 47 is installed from the lower direction of the screw holes 12 and 44 through a hinge stopper 45.

The reinforcement plate 36 for the hinge engaged with the lower hinge member 9 is installed in the door 2, 3 as a separate member from the reinforcement plate 35 for the cap. A portion which is engaged with the lower hinge member 9 and to which weight of the door 2, 3 is added is strongly reinforced, because the hinge reinforcement plate 36 is made by a steel plate thicker than that of the reinforcement plate 35 for the cap, whereby deformation and fallout of the door 2, 3 can be prevented.

The interior member 5 is made by a plate-like member, for example, made by a stainless steel, and an installing groove 64 for installing a gasket 30 on the outer peripheral portion is formed. The gasket 30 is an annular material, for example, made by a soft synthetic resin, has a hollow-body in an inner portion and is detachably installed in the installing groove 64 in the interior member 5.

In case where the door 2, 3 is constructed according to the above configuration, the interior member 5 is contacted with the inner surface of the flange 10 of the exterior member in which the handle 50 is installed. Then, the cap reinforcement plate 35 and the hinge reinforcement plate 36 are fixed by the fixing screws 42, 47 in the side of the doors 2, 3 that is supported by pivot. The cap 7 in the side that is supported by pivot is installed from the side that is supported by pivot. The reinforcement plate 60 for the upper cap and the reinforcement plate 61 for the lower cap are installed in the side of the door 2, 3 that is not supported by pivot, and the cap 8 in the side that is not supported by pivot is installed from the side that is not supported by pivot. And, the foam heat-insulated material is filled in the space formed by the interior member 5, the exterior member 4 and the cap 7, 8. Finally, the gasket 30 is installed on the interior surface 5 to obtain the door 2, 3.

According to the above configuration, it is not necessary to form flanges, which are bent to the side of the interior member 5, in both sides of the exterior member 4, and therefore, the shape of the exterior member 4 is simplified and the productivity can be increased.

Since the cap 7, 8 extends upward and downward in both (left and right) sides of the door 2, 3, dust is less accumulated on the cap than the door having cap in the top and bottom thereof. In other words, the door 2, 3 is more sanitary.

As described above, according to the invention, the cooling receptacle having the storage room in heat-insulated housing which has the opening in front side, said opening adjustable to open or close with the door in which the insulating material is filled, is composed of the cut formed in exterior member of the door, the screw hole formed in the exterior surface near the cut, the handle base connected to the cut so as to cover the cut, the handle provided on the handle base and fixed in the exterior member with the screw which is screwed in the screw hole, the flange provided in the back surface of the exterior member in which the screw hole is placed, and the holding section for the nut member which is held between the holding section and the exterior member by screw. Accordingly, the flange of handle base is held in the back side of the exterior member and the handle is placed in the handle base face to face, and the handle, the exterior member and the handle base are fixed together by screw.

The holding section on which the nut member to be screwed with the screw can be held is formed in the flange of the handle base. As a result, the screw can be easily conformed to the nut member and the handle can be strongly fixed in the exterior member.

In case where the handle is installed, the nut member is placed in the holding section of the handle base and the flange of the handle base is slid along the back side of the exterior member to hold the handle base in the cut of the exterior member. As a result, operation for installing the handle can be simplified.

According to the second invention, since the holding section of the flange has further the path in which the insulating material is incorporated in addition to the first invention, the insulating material is incorporated through the path and is filled between the holding section of the flange and the exterior member, whereby the nut member existing in the holding section of the flange is pressed on the back side of the exterior member to strongly fix the handle base in the exterior member.

Although the invention has been described with respect to specific embodiment for complete and clear disclosure, the appended claims are not to be thus limited but are to be construed as embodying all modification and alternative constructions that may be occurred to one skilled in the art which fairly fall within the basic teaching herein set forth.

What is claimed is:

1. A cooling receptacle having a storage room in heat-insulated housing which has an opening in front side, said opening being adjustable to open or close by a door which is filled with an insulating material therein and stops up the opening, comprising a cut formed in an exterior member of the door, a screw hole formed in the exterior surface near the cut, a handle base connected to the cut so as to cover the cut, and a handle provided in the handle base and fixed in the exterior member by the screw which is screwed to the screw hole, said handle base being provided with a flange extending to a back surface of the exterior member in which the screw hole is placed, and said flange having a recess adapted to receive a nut member which is held between the recess and the exterior member by screw.

2. The cooling receptacle according to claim 1 wherein the recess of the flange has a path in which the insulating material is incorporated.

* * * * *